US007854399B2

(12) United States Patent
Sirkin

(10) Patent No.: US 7,854,399 B2
(45) Date of Patent: Dec. 21, 2010

(54) FLOW CONTROLLABLE SHOWER ARM

(76) Inventor: Theodore M. Sirkin, 23262 Oxnard St., Woodland Hills, CA (US) 91367

( * ) Notice: Subject to any disclaimer, the term of this patent is extended or adjusted under 35 U.S.C. 154(b) by 0 days.

(21) Appl. No.: 10/215,079

(22) Filed: Aug. 7, 2002

(65) Prior Publication Data

US 2003/0006318 A1 Jan. 9, 2003

Related U.S. Application Data

(63) Continuation-in-part of application No. 10/027,335, filed on Dec. 19, 2001, now Pat. No. 6,799,732, which is a continuation-in-part of application No. 09/755, 793, filed on Jan. 5, 2001, now Pat. No. 6,568,608.

(51) Int. Cl.
*B05B 1/30* (2006.01)

(52) U.S. Cl. ..... 239/580

(58) Field of Classification Search ..... 239/569, 239/578, 580, 581.1, 581.2, 582.1, 1, 396, 239/DIG. 15, 586
See application file for complete search history.

(56) References Cited

U.S. PATENT DOCUMENTS 1,996,545 A * 4/1935 Knowlton ..... 239/460
2,448,792 A * 9/1948 Fraser ..... 239/460
3,042,312 A * 7/1962 Packard ..... 239/315
3,554,218 A * 1/1971 Smith ..... 137/385
3,831,860 A * 8/1974 Gullaksen et al. ..... 239/500
4,134,573 A * 1/1979 Messinger ..... 251/324
4,573,639 A * 3/1986 Logue ..... 239/428.5
5,360,172 A * 11/1994 Wang ..... 239/586
5,937,451 A * 8/1999 Mihara ..... 4/448
6,029,683 A * 2/2000 Moebs et al. ..... 137/15.01
6,499,678 B1 * 12/2002 Hope ..... 239/581.1

* cited by examiner

*Primary Examiner*—Davis Hwu

(57) ABSTRACT

As a method to conserve water, a flow controllable shower arm or an adaptive fitting attachment to an existing shower arm having an unobtrusive and relatively unobservable tool-operative feature, which allows authorized personnel in possession of a particular tool to control the amount of water flow into and through a downstream showerhead. In particular, a small valve is located in the shower arm or the adaptive attachment and has a threaded plug which can extend into or out of the axial water duct of the arm or rotate a maximum of 90 degrees within the arm to thereby block water flow or permit water flow. A tool-receiving end is provided at the outer portion of the plug to eliminate or at least minimize access to said flow control by the person taking the shower.

17 Claims, 4 Drawing Sheets

FLOW CONTROLLABLE SHOWER ARM

RELATED APPLICATIONS

This application is a continuation-in-part of my U.S. patent application Ser. No. 10/027,335, filed Dec. 19, 2001, for Water Sprinkler Head with Integral Off-On Water Flow Control Valve and Adaptive Fittings Therefor (now U.S. Pat. No. 6,799,732, dated Oct. 5, 2004), which is, in turn, a continuation-in-part of my U.S. patent application Ser. No. 09/755,793, filed Jan. 5, 2001, for Water Sprinkler Head with Integral Off-On Water Flow Control Valve and Adaptive Fittings Therefor (now U.S. Pat. No. 6,568,608, dated May 27, 2003).

BACKGROUND & INTENT OF THE INVENTION

For the last ten years, the populace of the United States, especially in the southern regions, had been hearing about the pending scarcity of water. That scarcity has now arrived. The growing population and longer life expectancy have increased the populations of not only the USA but throughout the world. The growth of water resources, though, has not kept up with the growth in population and water is becoming more and more scarce. The world is now awakening to the fact that water is a 'finite resource'. In the southern half of the United States, for example, many municipalities have initiated water restrictions and now water restrictions are becoming common in the northern half, as well. It is now becoming obvious to the general populace that if individual homeowners, businesses and even governmental agencies do not make concerted efforts to cut down on their water usage, water rationing measures will only grow more severe.

It is common knowledge that the biggest user of water inside the home is the shower. It goes without saying that the biggest user of water in a hotel or motel is also the shower. In dormitories, schools, hospitals, prisons and military bases, most water used inside the buildings is due to the consumption of water used for showering.

Additionally, water used in a shower has to be heated, hence, the use of energy also comes into play. Most often the water is heated by natural gas, propane, electricity or by coal. These heat-generating sources involve fossil fuels and contribute to commodity shortages and, in the eyes of many, global warning. In any event, the cost of energy has also been rising as the world has become aware that fossil fuel deposits are a finite source, not an infinite source. Heating hot water constitutes a significant percentage of the total energy consumed in a home so that any reduction of hot water use makes an important contribution to energy conservation.

The present invention relates to a method of saving substantial water and the energy used to heat that water used in showers by controlling the flow of water prior to reaching the shower head. Generally speaking, the short piping immediately prior to the showerhead and to which the showerhead is attached, is known as a shower arm. In almost every shower in North America, shower arms are made of half-inch piping or tubing and have half-inch ASTM male pipe threads at both ends. With almost every showerhead manufactured in North America, the upstream end is fitted with a half inch ASTM female threaded connector for attachment to the downstream end of the shower arm. Other than the hot and cold water shower handle or handles, depending on the style, the only other parts of the shower one sees is the shower head and the shower arm. All the other piping of a normal shower assembly is hidden behind or within the wall behind the shower apparatus and most of that piping is generally always one-half inch.

The principal water flow controls of a shower are the hot and cold water handles with which the user in the shower regulates the flow volume and the temperature. The novelty of the present invention places—for the first time—a secondary water flow control method into the shower arm. All prior art has placed the secondary water flow control into a segment of a showerhead. The new art allows for flow reduction very different from that normally found in a showerhead. In every case, the flow control apparatus within a showerhead is there so that the person using the shower can easily control the water flow at will. This is in sharp contrast to the intent of the present invention, which, in the interest of conserving water, is to take the control over water flow away from the person who is taking a shower. Hotel management, for example, may not be able to control the time a guest spends in the shower but with the new art, management can now easily and inexpensively control the volume to the showerhead. The present invention provides for flow control over the water that exits the showerhead irrespective of the type, style, brand or advertised benefits of whatever showerhead is presently being used in the shower.

A novel feature of the present invention is that the flow control valve in the shower arm is a simple set screw inserted into a section of the shower arm with the set screw having an outer end designed to receive a small tool. This allows for the tool to be an Allen wrench or the tool-receiving end can even be designed to accept a specially-designed tool to further limit the tool's availability and limit access to those who would try to defeat the intent of saving water. In either case, the chance of a person being in the shower with the required tool to change the setting is severely reduced. In the case of a specially-designed tool, it would be almost impossible for the user to change the settings.

Additionally, the preferred embodiment brings forth one of the more novel features of the invention which suggests that the water flow control is a rather small screw located in an obscure part of the shower arm to reduce its visibility to the shower user so that the user may not even become aware of its presence. To further minimize the awareness of the little valve, all that is visible is a very small part of just one end of the screw. The valve screw, or valve plug as it is usually called, only goes into the shower arm from one side of the pipe and does not pass through to the other side.

Therefore, a most important feature of the present invention provides a flow control valve means that is basically intended for use by one, or a representative of one, who is responsible for initiating water conservation policy and generally who is also responsible for paying the water and energy bills. The new art is mainly directed for the benefit of management at hotels and motels, water management personnel for schools, gymnasiums, prisons, military installations, and wherever shower usage results in large amounts of water and energy being expended. Also, the new art is directed towards the bill-paying parents in families where pre-teen and teenage children oftentimes take longer showers than may be necessary. In all the above cases, the users generally have little or no concern for the water being used while they shower but those who pay the water bills each month are monetarily penalized due to that lack of concern.

The clear intent of the invention is to make it difficult for the user in a shower to alter the flow settings that have been established by the person who is responsible for paying the water and energy bills. The reduction of flow will result in less GPMs (gallons per minute) being expended by the user in the shower, which will result in lower water usage and lower water and energy bills for the person who must pay those bills.

BRIEF DESCRIPTION OF THE DRAWINGS

Figure 1:
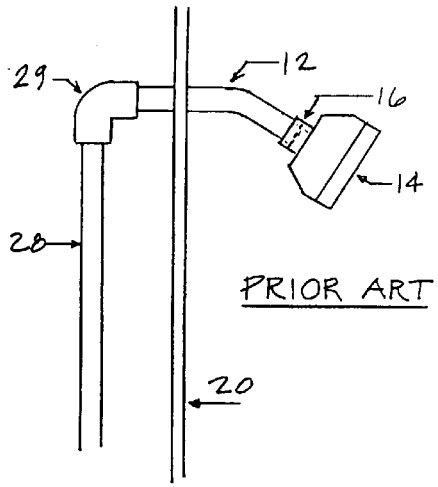
Figure 2:
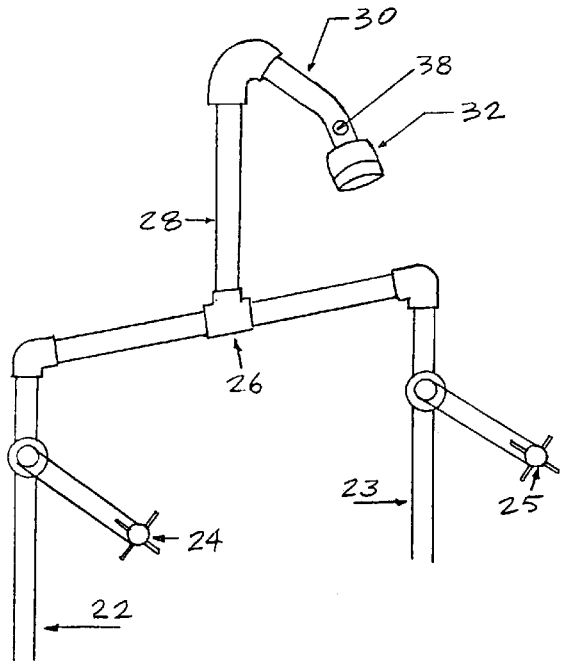
Figure 3:
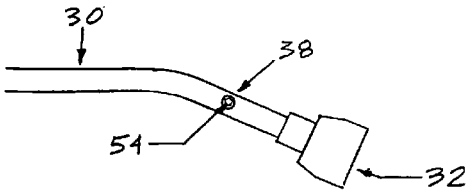
Figure 4:
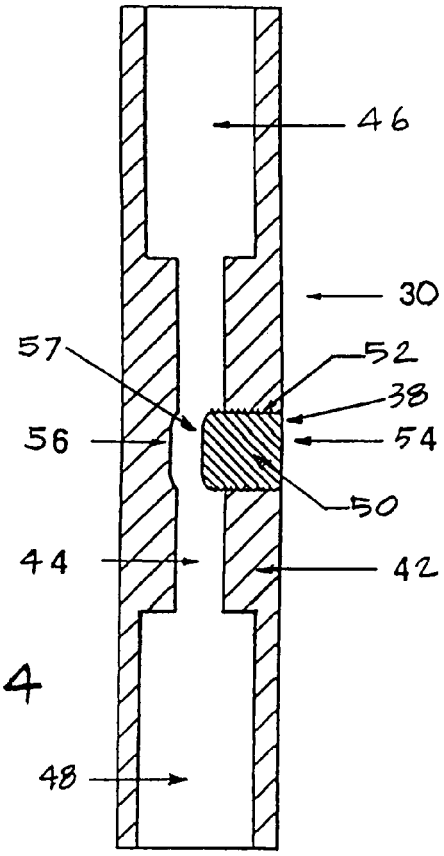

Having thus described the invention in general terms, reference will now be made to the accompanying drawings in which:

FIG. 1 is a side elevational view of one prior art assembly, showing the use of a flow restrictor inserted into the half-inch female threaded cavity area of a typical showerhead whereby the showerhead is threaded onto a shower arm;

FIG. 2 is a partial schematic perspective view showing a shower head assembly constructed in accordance with and embodying the present invention with a piping arrangement supplying water thereto;

FIG. 3 is a side elevational view of the shower arm of FIG. 2, with the control valve incorporated therein;

FIG. 4 is an enlarged cross sectional view of the control valve of FIG. 2 and its adjacent area, showing a valve plug in a diametrically reduced section of the stem, and in an open position so as to permit full water flow through the duct of the stem.

Figure 5:
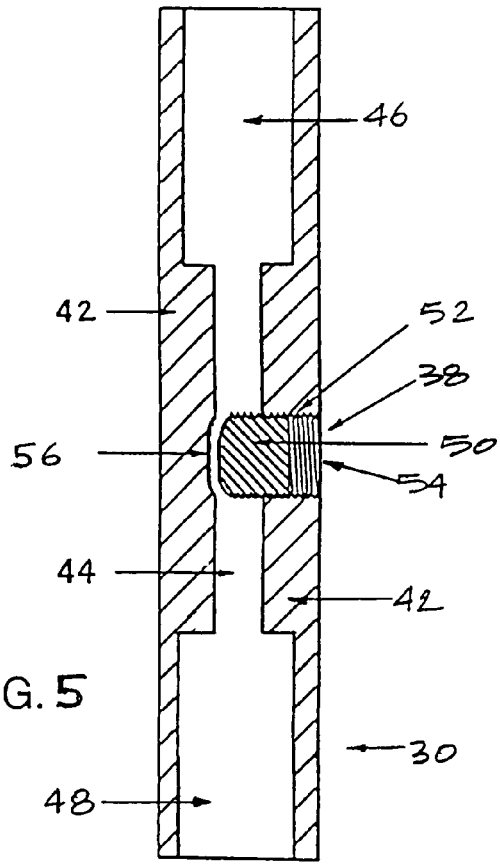

FIG. 5 is an enlarged cross sectional view, similar to

Figure 6:
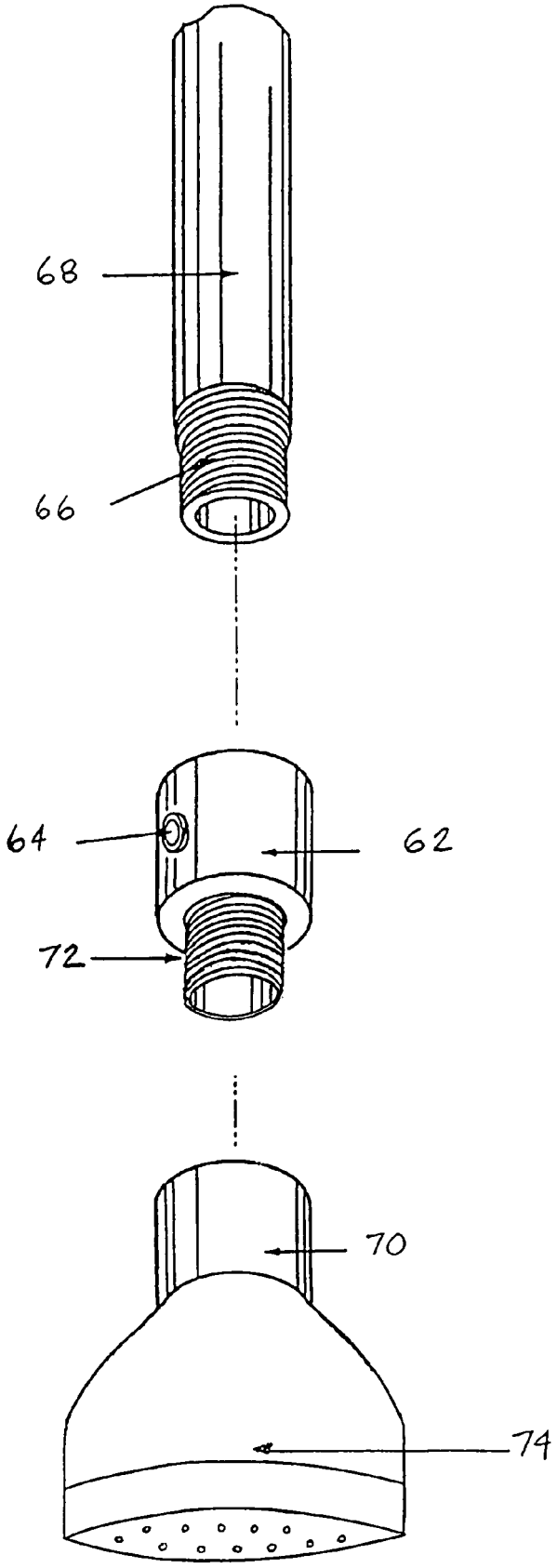
Figure 7:
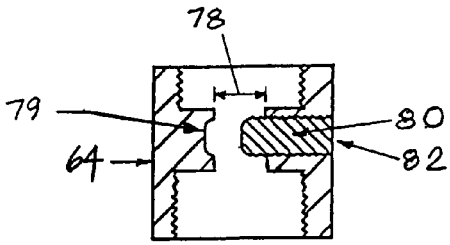
Figure 8:
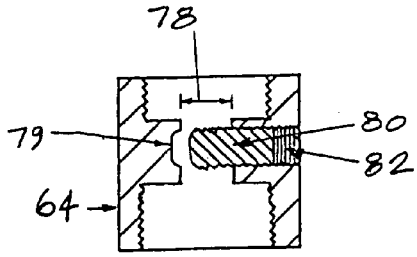
Figure 9:
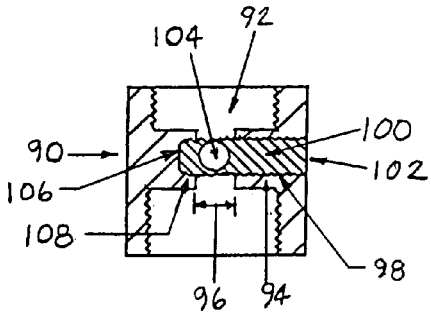
Figure 10:
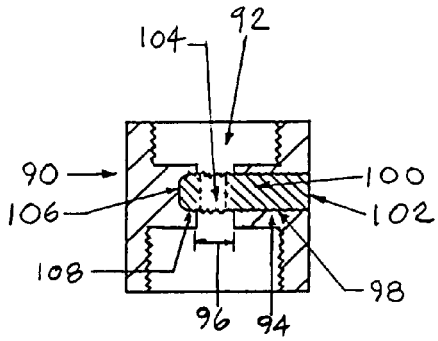

FIG. 4, showing the valve plug in a partially closed position, to thereby reduce water flow through the valve arrangement;

FIG. 6 is an exploded perspective view, showing a modified form of shower arm assembly, in which the control valve is mounted within a half-inch fitting interposed between the shower arm and a shower head;

FIG. 7 is a vertical sectional view, somewhat similar to FIGS. 4 and 5, and showing a slightly modified form of valve arrangement in accordance with the present invention, and with the valve arrangement almost fully opened to permit substantial water flow therethrough;

FIG. 8 is a vertical sectional view, similar to FIG. 7, and showing the modified valve arrangement of FIG. 7 with the valve plug partially closed to thereby reduce water flow through the valve arrangement of FIG. 7;

FIG. 9 is a vertical sectional view, somewhat similar to FIG. 7, and showing a further modified form of valve plug, in which a hole is used in the valve stem to control water flow, and where the valve stem is in a fully closed position to stop water flow;

FIG. 10 is a vertical sectional view, somewhat similar to FIG. 9, and showing the valve stem rotated 90° to a fully opened position, so as to completely allow full water flow through the stem;

DETAILED DESCRIPTION OF A PREFERRED EMBODIMENT

Prior to discussing the details of the present invention, and referring particularly to FIG. 1, there is a typical shower arm 12 with standard half-inch male pipe threads at both ends, to which is attached a common showerhead 14. Just inside the ½" female threaded section of the showerhead that connects to the shower arm is a flow restrictor 16. Most often, the flow restrictor is nothing more than a manually-inserted plastic washer and the amount of restriction depends on the size of the hole in the center of the washer.

However, by engaging the showerhead 14, it is relatively easy to unscrew the female threaded end of the showerhead 14 from the male threaded end of the shower arm 12 and remove the restrictor 16 to effectively frustrate the flow control purpose. In such event, the control over the amount of water flowing through the showerhead no longer lies with the party having the responsibility for water flow control.

Referring now in more detail and by reference characters to the drawings, which illustrate several preferred embodiments of the invention, FIG. 2 illustrates a typical showerhead 32, which is similar or identical to 14 shown in FIG. 1 but without the flow restrictor, connected to a shower arm 30 embodying the present invention, which is connected upstream to a conventional piping arrangement, with conventional hot and cold water control valves therefore.

Referring specifically to FIGS. 1 and 2, it can be observed that there is a vertical wall 20 forming part of a shower stall. Located behind that wall is a hot water supply line 22 and a cold water supply line 23. A manually controllable valve 24 is operatively connected to the hot water supply line 22, to control the amount of hot water flowing through that line. A cold water control valve 25 is mounted with respect to the cold water supply line 23, in order to control the amount of cold water flowing through the line 23. It can be observed that these supply lines are located behind the wall 20, with the valves 24 and 25 located on an opposite side of the wall for accessing by the user.

FIG. 2 shows both supply lines behind wall 20, not shown in FIG. 2, connected to a T-fitting 26 and an upwardly directed pipe 28, to which the half-inch shower arm 30 is connected with the showerhead 32 being connected to the shower arm via the half-inch male pipe threads at the downstream end.

Therefore, in accordance with the arrangement thus described, the user of the shower can control the temperature of the water, by mixing of water from the hot and cold water sources, and similarly via the manually turnable valves 24 and 25, can also control the water flow.

However, in accordance with the present invention and as shown in FIGS. 2 and 3, there is provided a small, manually actuable water flow control valve 38, mounted into the piping that constitutes the half-inch shower arm 30. Said flow control valve provides overriding of the water flow regardless of the type, make or design of the showerhead and regardless of how open or closed are the manually turnable valves 24 and 25. This manually actuable flow control valve 38 is more fully illustrated in FIGS. 4 and 5 of the drawings.

Referring to FIGS. 4 and 5, the arm 30 is provided with a thickened wall section 42, forming a diametrically reduced water passage 44. The thickened wall section 42 is necessary to accommodate the flow control valve 38.

Therefore, as shown in FIGS. 4 and 5, in a typical embodiment, the water passage opens to a full diameter duct 46 at the upper or inlet end, and also to a full diameter duct 48, at the lower or outlet end thereof.

Located within the region of the thickened wall section 42 is the water flow control valve 38, constituted of a valve plug 50, which is threaded into a bore 52, formed in the side wall of the thickened wall section 42 of the shower arm 30.

The plug 50 is provided at its outer end with a tool-engaging end 54, as shown in FIG. 3. Thus, it will require a tool to rotate the plug 50 within the threaded section of the bore 52. Moreover, it can be observed that the plug 50 is angularly located and, preferably, perpendicular to, the axis of the duct 44.

In accordance with this construction, and as more fully shown in FIG. 4, the valve plug 50 can be withdrawn to a position where it is largely removed from the diametrically reduced passage 44, thereby allowing full water flow through that diametrically reduced passage. Moreover, and by reference to FIG. 5, it can be observed that the valve plug 50 can be threaded in to a partially or fully closed position within the diametrically reduced duct 44 to restrict or severely impede water flow.

For purposes of achieving a better water shut off when seating the valve plug 50 against the opposite wall of the diametrically thickened section 42, a recess 56 may be provided in that diametrically thickened wall to receive an inner end 57 of the valve plug 50, which is sized to be engaged in that recessed area 56, all as best shown in FIGS. 4 and 5 of the drawings.

By further reference to FIGS. 4 and 5, it can be observed that the amount of water flowing to the showerhead can be controlled by selective positioning of the plug 50, within the diametrically reduced duct 44. Thus, if the plug 50 was rotated until it blocked a substantial portion of the diametrically reduced duct 44, only a limited amount of water flow would be permitted. However, by gradual retraction of the plug 50 out of the diametrically reduced duct 44, water flow is gradually increased.

FIGS. 4 and 5 of the present invention are similarly described and shown as FIGS. 5 and 6 of the inventor's U.S. Pat. No. 6,568,608 issued on May 27, 2003 relating to irrigation parts used in sprinkler systems.

One of the important facets of this invention, is that the tool receiving end 54 should preferably be provided with either a recess or a protrusion, capable of being engaged only by a specific type of tool. An Allen wrench or a special key may be suitable for this purpose. However, other less common or more common tool-engaging ends could also be provided. In this way, those who have the responsibility or the financial interest in controlling water and energy consumption are able to decide themselves on the ease or difficulty of making adjustments to the valve plug.

FIG. 6 illustrates, in exploded view, an embodiment of the invention in which the flow control valve arrangement is mounted within a half-inch adapter 62. In this case, the flow control valve arrangement 64 is similar to the previously described flow control valve arrangement, in that it may use the plug 50. Reference is again made to the Inventor's U.S. Pat. No. 6,568,608 in that Number 62 in FIG. 10 is essentially the same as Number 62 in FIG. 6 of the present invention and functions in a similar fashion.

Generally, all showerheads, such as the showerhead 74, are mounted onto the downstream end of shower arm 68 via the half-inch male threads 66 located at the end of said arm. All typical showerheads are provided with half-inch internally threaded ends 70 for attachment thereto. However, in the embodiment of the invention, as shown in FIG. 6, the adapter 62 is provided with a half-inch internally threaded socket, not shown, which allows for insertion between the (ordinary) shower arm 68 and the showerhead 74 by threadedly securing the adapter 62 to the threaded end 66 of the arm. Moreover, the fitting 62 is provided with a half-inch outwardly extending, externally threaded section 72 of even diameter, which allows for connection to the half-inch internally threaded end 70 of the showerhead 74.

This embodiment of the invention, as shown in FIG. 6, allows for a very simple retrofit arrangement of the valve component of the invention, merely by removing the shower head 74 from the half-inch threaded section 66 of the shower arm 68, inserting the adapter 62 onto said shower arm and rethreading the showerhead 74 onto the half-inch male threaded extended end of the adapter 62. This arrangement is desirable when it would be most difficult to replace the existing shower arm with one embodying the new invention.

FIG. 6 highlights one of the versatile aspects of the invention, in that shower arm flow control can easily be added, removed or reincorporated in a relatively simple manner.

Similarly, as in the embodiment shown in FIG. 3, the outer end of the valve plug 64 is adaptable to receive a specialized tool, leaving the control over the amount of water flow with one who possesses such a tool.

FIGS. 7 and 8 show a very similar valve arrangement 64 as that shown in FIGS. 4 and 5, but with a shorter diametrically reduced water passage section 78, receiving a valve plug 80, having an outer end 82. In FIG. 8, the plug 80 is shown as being engaged closer against the recess 79, in that valve plug 80 has been turned and thereby moved within the duct so that there is only a partial flow. As in FIGS. 4 and 5, it can be observed that the valve plug 80 can be withdrawn to a position as shown in FIG. 7, where there is full water flow through the valve.

FIGS. 9 and 10 illustrate a modified embodiment of the invention, specifically a modified valve plug, and comprise a shower arm 90 having a central duct 92 and a thickened wall section forming a diametrically reduced duct section 96. A plug receiving opening or bore 98 is formed within the thickened wall section 94, and receives a valve plug 100. Again, the valve plug 100 would be provided with a specialized tool-receiving end 102, which would normally not be easily accessible to one who was taking a shower. The valve plug 100 is also threaded over at least a portion of its length for threaded engagement within the threaded bore 98. In this way, rotation of the valve plug will cause a shiftable movement. However, in this embodiment as shown in FIGS. 9 and 10, the valve plug is provided with a central aperture 104.

By further reference to FIGS. 9 and 10, it can be observed that when the valve plug 100 is rotated to the position as shown in FIG. 9, there is a complete blockage of water flow through the duct 92 and the diametrically reduced duct section 96. This is due to the fact that the aperture 104 is out of alignment with the diametrically reduced duct section 96. However, when the valve arm 100 is rotated 90° to the position as shown in FIG. 10, full water flow is again permitted. By rotating the valve plug between the positions as shown in FIGS. 9 and 10, control of the water flow through the diametrically reduced duct section 96 and the duct 92 is exercised.

The plug 100 has an inner end 106 which is sized to fit within a recess 108, formed in the thickened wall section 94. However, one of the advantages of this valve arrangement of FIGS. 9 and 10, is the fact that it is only necessary to rotate the valve plug through a 90° arc from full water flow to no water flow, and moreover, to any position therebetween. Reference is made to the Inventor's U.S. Pat. No. 6,799,732 in that FIGS. 14 and 15 are essentially the same as FIGS. 9 and 10 of the present invention and function in the same fashion.

The embodiment and application shown in FIGS. 9 and 10 are equally applicable to the embodiments shown and described in FIGS. 4, 5, 6, 7 and 8.

The valve plug in any of the previously described embodiments of the invention, can easily adopt the form of a one-eighth to three-eighths inch diameter set screw, and is thus readily available. Moreover, and when the valve is in the closed position, it is not necessary to fully close off water flow. When the valve plug is moved to the closed position, it will reduce water flow so substantially, that it would be impractical for one to shower with the available water passing therethrough.

However, this invention is nevertheless highly effective, most notably in its major objective, which is to save water and energy by curbing domestic water usage, in that a full range of water flow control in a shower is provided between the two end positions of the flow control valve plug in a shower arm with no ability by the person in the shower to change a predetermined setting without being aware of the valve plug's existence and without the proper tool with which to make the change.

We now refer again back to FIGS. 2 and 3 wherein the valve plug 38 is shown on the side of the shower arm 30. In order to minimize the shower user's ability to become aware of the valve plug's existence, it is noted that the location of valve plug 38 in those two figures is diagrammatical only in that a preferred location of valve plug 38 would be on the underside of the shower arm 30 being optimally located between the bend of the shower arm 30 and the shower head 32.

The practicality of the range of water flow control provided by the invention is most notable when a simple 10%-15% reduction in water exiting any showerhead available today on the market occurs without the person taking the shower being fully aware of the reduction in water. A reduction in excess of 15% will likely be noticeable to the person taking the shower but unless the person taking the shower is aware of the existence of the manually actuable flow control valve and also possesses the proper tool, the valve plug setting would be under the control of the person or company who is responsible for the water and/or has a financial interest in its use.

As with common shower arms available on the market, the shower arm, which is the subject of this present art, can be constructed of a variety of materials, and the components do not necessarily have to be constructed from the same material. For example, it is possible to use a metal shower arm with a plastic flow control valve arrangement. The arm and the adapter with the valve therein can be easily manufactured from a variety of suitable materials.

Thus, there has been illustrated and described a unique and novel Flow Controllable Shower Arm, and which thereby fulfills all of the objects and advantages which have been sought. It should be understood that many modifications, changes, variations and other uses and applications will become apparent to those skilled in the art after considering the specifications and the accompanying drawings.

Therefore, any and all such changes, modifications, variations and other uses and applications that do not depart from the spirit and scope of the invention are deemed to be covered by the invention

The invention claimed is:

1. A shower arm for use in a shower stall and which is connectable to a shower water supply through a shower water supply pipe and having an unobtrusive and relatively unobservable water flow control means for controlling the amount of water entering into a downstream-located showerhead, said shower arm being comprised of:

a) A singular section of standard ASTM one-half inch diameter pipe generally bent in the middle, connected at the upstream end to the water supply outlet pipe, which water supply outlet pipe is normally concealed behind a wall of the shower stall, and connected at the exposed end to a shower head or shower head assembly; and b) said shower arm constituting the downstream terminus of all the piping that constitutes the water supply piping to the shower head or shower head assembly; and c. said shower arm also having a downstream end comprised of ½" MIPT (Male Industrial Pipe Threads) enabling connection thereto of a shower head or shower head assembly equipped with one-half inch FIPT (Female Industrial Pipe Threads) at the upstream end therein; and d. said shower arm having an internal duct extending therethrough and being in fluid communication with said water supply piping at the one end and a shower head or shower head assembly connected to the other end; and e. said duct having a small section therein that is diametrically reduced thereby creating a reduced duct section within said shower arm in order to accommodate said water flow control means, said diametrically reduced duct section being that portion of said shower arm which has increased wall thickness in said duct with respect to the remaining portion of the duct; and f. said water flow control means therefore being located in the piping downstream of the main hot and cold water manual control valves located within the shower stall that normally control the water supply to the shower head, but slightly upstream of said shower head, so that said water flow control means is capable of overriding the amount of water normally provided through said main manual control valves, thereby providing a discreet secondary capacity, which is relatively unobservable by the user of the shower, in order to limit the amount of water which can pass through the water supply piping to said downstream shower head independently of said main manual control valves; and g. said water flow control valve means comprising a manually actuable valve plug extending into the reduced diameter duct section of said shower arm and being at a substantial angle with respect to an axis of said duct for controlling water flow in proportion to a position of the plug in said duct between a first end position and a second end position allowing full water flow in said first position and a blocking of water flow in said second end position and will reduce water flow proportionally when said plug is moved from said first end position to said second end position; and h. said manually actuable valve plug having an outer tool-receiving end, said tool-receiving end being the only visible portion of the water flow control means on the exterior surface of the shower arm; and i. said water flow control valve means is controllable only by a small, proper hand tool used to control water flow when in connection with said tool-receiving end of said manually actuable plug, said tool not a part of the valve but being physically separate from said valve means, hence not readily accessible by a person in the shower, and which is normally in the possession of maintenance personnel specifically to adjust the water volume through the valve to a desired water flow, thereby providing an environmental savings by reducing unapproved alteration of water flow volume by anyone other than the entity responsible for controlling water usage; and j. said manually actuable valve plug controlled by said proper tool allows for the desired amount of flow in response to at least a slight axial shifting of position of the plug between said first position and second end position.

2. The Shower Arm of claim 1 having a preferred embodiment of the manually actuable valve plug having an outer tool-receiving end of said plug that causes threaded turning of said plug into and out of said duct.

3. In another embodiment of said manually actuable valve plug of the Shower Arm of claim 1, said tool-receiving section at the outer end of said plug causes threaded rotating of said plug within said duct a maximum of 90 degrees between said first and second end positions.

4. The Shower Arm of claim 1 having said tool-receiving outer end of said manually actuable plug utilizing a tool that can be relatively common or by choice can be of a custom design.

5. The shower arm of claim 1 in which said manually actuable valve plug has a diametrical size at least as large as that of the diametrically reduced duct section.

6. The water flow control valve means of claim 1 of which said valve plug is manually actuable for controlling water flow through said duct and extends into said reduced duct section generally perpendicular to a central axis of said duct.

7. The shower arm of claim 1 in which said manually actuable plug enters only into one side of said shower arm, but does not pass through the opposite side of said shower arm minimizing visibility so that it is generally unobtrusive and unobservable.

8. A water flow control valve means of claim 1 in which said manually actuable valve plug is held in place by having exterior threads that correspond to and engage an interiorally threaded bore into said diametrically reduced duct section whose axis is generally perpendicular to the axis of the duct.

9. The manually actuable valve plug of claim 1 being manually shiftable so that it blocks water flow when in said second end position and will reinitiate a flow of water when said plug is in the first end position and proportionally decreases flow during shifting from the first to the second end positions without any disassembly or unintended interference with operativeness of the shower or the main controls thereof.

10. An adapter for downstream attachment to an existing shower arm having an unobtrusive and relatively unobservable water flow control means for controlling the amount of shower water passing from the shower arm into and through a downstream-located shower head, said adapter comprising:

a) a fitting with an upstream end having one-half inch FIPT (Female Industrial Pipe Threads) in order to be connectable to the downstream end of a common one-half inch diameter ASTM shower arm and having a duct for the passage of water from the shower arm through the fitting and downstream to a shower head connected thereto; and b) said adapter having one-half inch MIPT (Male Industrial Pipe Threads) at the lower or downstream end for attachment of a shower head or shower head assembly equipped at its upstream end with one-half inch FIPT (Female Industrial Pipe Threads); and c) said water flow control means therefore being located in the piping downstream of the main hot and cold water manual control valves located within the shower stall that normally control the water supply to the shower head, but slightly upstream of said shower head, so that said water flow control means is able to override the amount of water normally provided through said main manual control valves, thereby providing a discrete secondary capacity to limit the amount of water which can pass through the water supply piping to said downstream shower head or shower head assembly independently of said main manual control valves; and d) said adapter having an internal duct extending therethrough and being in fluid communication with the water supply piping including said shower arm at the upstream end of said adapter and a shower head or shower head assembly connected downstream to the other end; and e) said flow control valve means having a diametrically reduced duct section with increased wall thickness surrounding a manually actuable valve plug extending into said reduced-diameter duct and being at a substantial angle with respect to an axis of said duct for controlling water flow in proportion to a position of the plug in said duct between a first end position and a second end position, allowing full water flow in said first position and a blocking of water flow in said second end position and which reduces water flow proportionally when said plug is moved from said first end position to said second end position without any disassembly or interference with operativeness of the shower or the main controls thereof; and f. said manually actuable valve plug having an outer tool-receiving end, said tool-receiving end being the only visible portion of the water flow control means on the exterior surfaces of said adapter; and g. said water flow control valve means being controllable only by a small, proper hand tool used to control water flow when in connection with said tool-receiving end of said manually actuable plug, said tool not a part of the valve but being physically separate from said valve means, hence not readily accessible by a person in the shower, and which is normally in the possession of maintenance personnel specifically to adjust the water volume through the valve to a desired water flow, thereby providing an environmental savings by reducing unapproved alteration of water flow volume by anyone other than the entity responsible for controlling water usage; and h. the tool receiving section of said manually actuable plug allowing for the placement of the flow control valve means into a position where the water flow cannot be changed or modified without a proper tool by the user of the shower; and i. said manually actuable valve plug being controlled by said proper tool allows for the desired amount of flow in response to at least a slight axial shifting of position of the plug between said first and second end positions.

11. The Adapter of claim 10 having a preferred embodiment of the manually actuable valve plug being an outer tool-receiving end of said plug that causes threaded turning of said plug into and out of said duct.

12. In another embodiment of said manually actuable valve plug of the Adapter of claim 10, said tool-receiving section at the outer end of said plug causes threaded rotating of said plug within said duct a maximum of 90 degrees between said first and second end positions.

13. The Adapter of claim 10 having said tool-receiving outer end of said manually actuable plugs utilizing a tool that can be relatively common or by choice can be of a custom design.

14. The adapter of claim 10 further characterized in that said plug is manually actuable and extends into said duct generally perpendicularly to a central axis of said duct for controlling water flow through said duct.

15. The adapter of claim 10 further characterized in that said plug has a diametrical size at least as large as that of the duct.

16. The adapter of claim 10 in which said manually actuable plug enters into one side of said adapter, not passing through the opposite side of said adapter, therefore minimizing visibility so that it is generally unobtrusive and not readily noticeable, said flow control valve means remaining easily accessible by one who is responsible for controlling the water flow into and through said shower head or shower head assembly.

17. A water flow control valve means of claim 10 in which said manually actuable valve plug is held in place by having exterior threads that correspond to and engage an interiorally threaded bore into said diametrically reduced duct section of said adapter whose axis is generally perpendicular to the axis of the duct.

* * * * *